US005437403A

United States Patent [19]

Lemanski, II

[11] Patent Number: 5,437,403

[45] Date of Patent: Aug. 1, 1995

[54] TRAVEL PACK WORN ON THE PERSON

[76] Inventor: Gerald Lemanski, II, 1300-A E. 8th St., Tempe, Ariz. 85281

[21] Appl. No.: 169,387

[22] Filed: Dec. 20, 1993

[51] Int. Cl.[6] ..... A45F 3/02

[52] U.S. Cl. ..... 224/208; 224/202

[58] Field of Search ..... 224/208, 209, 207, 206, 224/204, 205, 211, 216, 202, 215, 151

[56] References Cited

U.S. PATENT DOCUMENTS

| | | | |
|---|---|---|---|
| 4,428,514 | 1/1984 | Elf | 224/151 |
| 4,518,107 | 5/1985 | Amos | 224/215 |
| 4,674,664 | 6/1987 | Simon | 224/215 |
| 4,693,402 | 9/1987 | Comeau | 224/215 |
| 4,815,640 | 3/1989 | Johnson | 224/202 |
| 4,872,599 | 10/1989 | Hubbard et al. | 224/208 |
| 4,878,606 | 11/1989 | Miller | 224/208 |
| 4,986,458 | 1/1991 | Linday | 224/216 |
| 5,150,824 | 9/1992 | Alvarez et al. | 224/202 |

FOREIGN PATENT DOCUMENTS

| | | | |
|---|---|---|---|
| 016616 | 9/1993 | WIPO | 224/208 |

*Primary Examiner*—Henry J. Recla
*Assistant Examiner*—Charles R. Eloshway
*Attorney, Agent, or Firm*—Nissle, Tod R.

[57] ABSTRACT

A travel pack is carried at the front of a person and can, without requiring that the pack be removed and again placed on the person, be moved to the back of the person by simply sliding the travel pack over the body.

1 Claim, 1 Drawing Sheet

TRAVEL PACK WORN ON THE PERSON

This invention relates to luggage carried on the person.

More particularly, the invention relates to luggage which can be carried at the front of a person and can then, without requiring that the luggage be removed and again replaced on the person, be readily moved from the front to the back of the person by sliding and contouring the luggage over the body from the front of the person, over the side of the person, and to the back of the person.

Backpacks and other luggage carried on the person is well known in the art. See, for example, U.S. Pat. Nos. 4,428,514 to Elf and 4,961,522 to Weber. Such luggage is preferably carried at the front, at the side, or at the back of a user. A disadvantage of a backpack is that it ordinarily must be removed from the back of the user before the user can access the backpack. It would, when the backpack was being accessed by the user, be desirable to have the backpack positioned at the front of the user. At the same time, when the user is hiking or climbing it is often preferred that the backpack be at the back, and not the front of the user. Since moving a backpack from the user's back to the front of the user is simply not possible, hikers and other individuals using backpacks have for many years accepted the fact that the backpack must be removed for the user to access conveniently the backpack.

It would be highly desirable to provide a backpack which could, while worn on the person, be moved from the back to the front of the user to facilitate accessing of the backpack by the user.

Therefore, it is a principal object of this invention to provide improved luggage which is worn on the person.

A further object of the invention is to provide an improved travel pack which can be readily accessed by the user when the travel pack is positioned at the front of the user and which can be moved from the front to the back of the user without requiring that the travel pack be removed or pulled off of the user.

Another object of the invention is to provide an improved travel pack which is adapted to slide over, alter shape, and contour to the user's body to facilitate movement of the travel pack from the front to the back of the user, or vice-versa.

These and other, further and more specific objects and advantages of the invention will be apparent to those skilled in the art from the following detailed description thereof, taken in conjunction with the drawings, in which.

Briefly, in accordance with my invention, I provide a carrier adapted to mounted on a user. The carrier includes a first trap shaped to circumscribe and slide around the body of the user, to extend under the arm on one side of the user and up and over the should on the other side of the user; a second strap spaced apart from the first strap and shaped to circumscribe and slide around the waist of the user, the space between the first and second straps on the one side of the user being less than the space between the first and second straps on the other side of the user; and, a travel pack extending from the first to the second strap for carrying articles. The travel pack slides around the body of the user from the front, over a side, and to the back of the user and includes at least a pliable back panel normally positioned against the body of the user, and a pliable front panel connected to the back panel. The back and front panels at least partially bound and define a storage chamber. The travel pack is shaped and dimensioned to bend and to contour around the user's body when the space between the first and second straps is reduced by sliding the travel pack from the front of the user to one side of the user.

Figure 1:
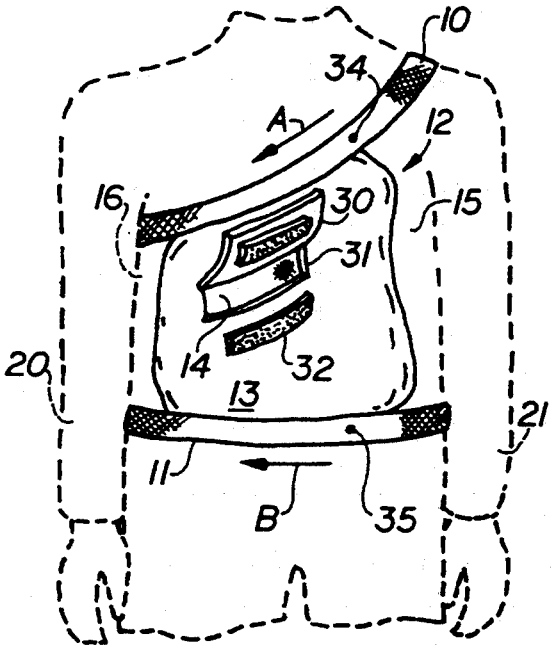
FIG. 1 is an elevation view illustrating an article carrier constructed in accordance with the principles of the invention and worn on the person with the travel pack positioned at the front of the user.

Turning now to the drawings, which depict the presently preferred embodiment of the invention for the purpose of illustrating the practice thereof, and not by way of limitation of the scope of the invention, and in which like reference characters identify corresponding elements throughout the several views, FIG. 1 illustrates an article carrier worn on a user. The article carrier includes a first strap 10 circumscribing the body of the user and extending over the right side 16, under the right arm 20, and over the left shoulder on the user's left side 15. A second strap 11 circumscribes the waist of the user. The space or distance between the first 10 and second 11 straps is least on the right side 16 of the user and normally increases as strap 10 extends from the right side 16 upwardly toward the left shoulder of the user.

Travel pack 12 extends between the first 10 and second 11 straps and includes pliable back panel 14 normally positioned against the body of the user and includes pliable front panel 13 connected to back panel 14. Front panel 13 can comprise a single relatively flat sheet of material, can comprise a face panel parallel to panel 14 and three or more side panels generally normal to panel 14 and to the face panel, or can take on any shape and dimension and include any number of interconnected panels. It only important that panels 13 and 14 at least partially bound and define a storage area or chamber. An opening 31 is formed in panel 13. The opening is closed by securing VELCRO closure material on flap 30 to the VELCRO closure material fixedly attached to panel 13. Articles are inserted in the travel pack 12 through opening 31. One or more openings 31 can be formed in panel 13. At least one of the openings preferably has a vertical mouth or mouth which is sloped like opening 31 so that accessing the opening with one of the user's hands is simplified when the pack 12 is positioned at the front 15 of the user and over the chest and/or stomach of the user.

Figure 2:
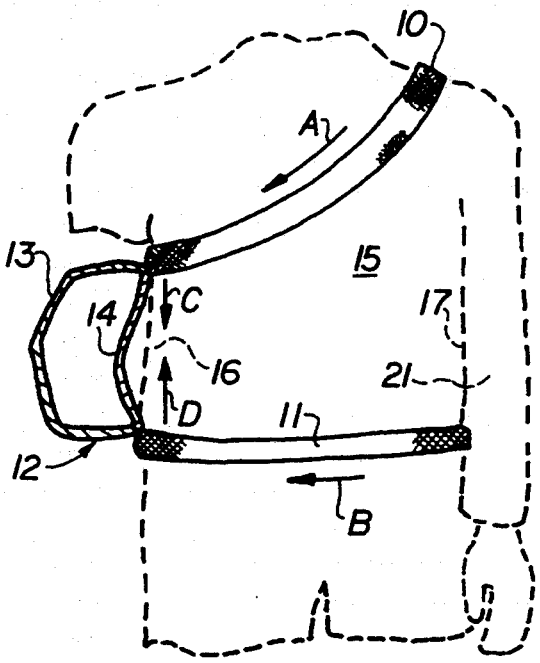
FIG. 2 is an elevation view illustrating the article carrier of FIG. 1 after the travel pack has been slide over the user to a position at the side of the user at which the ravel pack contours to the body of the user.
Figure 3:
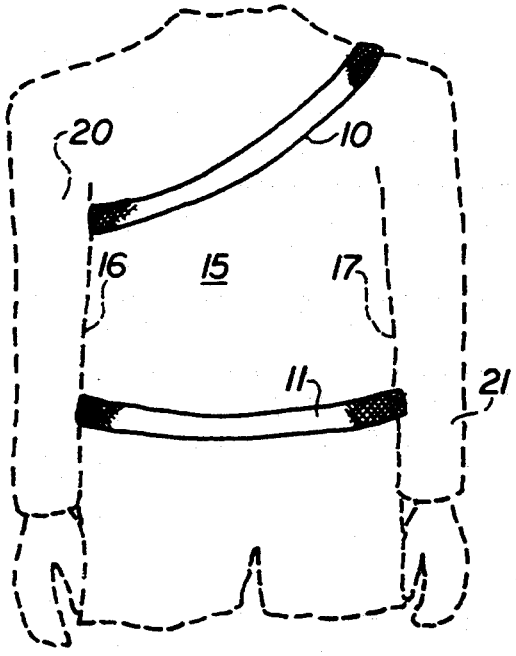
FIG. 3 is an elevation view illustrating the article carrier after the travel pack is positioned at the back of the user; and, FIG. 4 is a top view of the article carrier of FIG. 2 further illustrating contouring of the travel pack to the body of the user.
Figure 4:
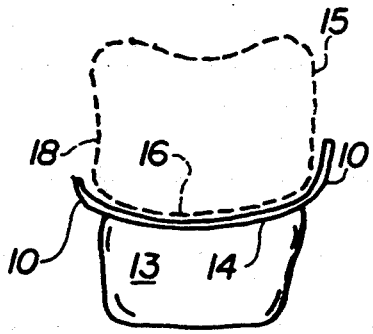

In order to move pack 12 from the front to the back of the user, straps 10 and 11 are slid over the body of the user in the directions of travel indicated by arrows A and B in FIG. 1. Sliding straps 10 and 11 in the directions of arrows A and B moves pack 12 first to the right side 16 of the user as shown in FIGS. 2 and 4, and then moves pack 12 to the back 18 of the user as illustrated in FIG. 3. When straps 10 and 11 are slid in the directions indicated by arrows A and B, the distance between two points 34 and 35 on straps 10 and 11, respectively, decreases as the points 34, 35 approach the right side 16 of the user. As pack 12 moves over the right side 16 of the user in the manner illustrated in FIGS. 2 and 4, the pliable panels 13 and 14 are compressed in the directions indicated by arrows C and D in FIG. 2 and must bend in order to permit points 34, 35 to move closer together as points 34, 35 approach and move over the user's right side 16. The outward bowing or bending of panels 13 and 14 is illustrated in FIG. 2. At the same time panels 13 and 14 bend as they slide over the user's right side 16, at least the portions of panels 13 and 14 adjacent straps 10 and 11 must conform to and curve around the user's right side 16 along with straps 10 and 11. The curvature and conforming of panels 13 and 14 to the right side 16 of the user can be seen in FIG. 4.

Each strap 10 and 11 can include a buckle to facilitate mounting of the straps on the body of a user. Or, straps 10, 11 can be elastic or otherwise sized or made such that they each comprise a continuous piece of material which is pulled over the head, arms, and torso of the user to the position illustrated in FIG. 1. Pack 12 can be sized or shaped to carry any desired kind of article or articles.

In FIG. 1 strap 10 slopes toward the right side 16 and arm 20 of the user. Strap 10 can, as would be appreciated by those of skill in the art, extend over the right should and under the left arm 21 so strap 10 slopes toward the left side 15 of the user.

In use, the article carrier is mounted on the user as shown in FIG. 1. To move the pack 12 from the front 15 to the back 18 of the user, straps 10 and 11 are manually pulled and slide over the body in the directions indicated by arrows A and B to slide pack 12 over the user's body, around the rights die 16, and onto the back 18 of the user. When the pack 12 is positioned on the front 15 of the user, opening 31 permits ready access to articles carried in the pack 12.

Having described the presently preferred embodiments of the invention in such terms to enable those skilled in the art to make and use the invention.

I claim:

1. A carrier adapted to be mounted on a user and including (a) a first continuous strap shaped to circumscribe and slide around the body of the user, and to extend under an arm on one side of the user and up and over a shoulder on an opposite side of the user;

(b) a second continuous strap spaced apart from said first strap and shaped to circumscribe and slide around a waist of the user, a space between said first and second straps on said one side of the user being less than the space between said first and second straps on the said opposite side of the user; and, (c) a travel pack connected to and extending between said first and said second straps for carrying articles, said and straps adapted to slide sliding around the body of the user from a front, over said one side, and to a back of the user and including at least (i) a pliable back panel normally positioned against the body of the user, (ii) a pliable front panel connected to said back panel, said back and front panels at least partially bounding and defining a storage chamber;

wherein said travel pack is shaped and dimensioned to bend and to contour around the user's body when the space between said first and second straps is reduced by sliding said travel pack from the front or back of the user to said one side of the user.

* * * * *